United States Patent [19]

Waters et al.

[11] 4,356,784

[45] Nov. 2, 1982

[54] INTEGRATED TUG-BARGE VESSEL

[75] Inventors: Michael J. Waters, Tracy; André Taschereau, St-Pierre de Sorel; Jacques Fortin, Sorel, all of Canada

[73] Assignee: Marine Industrie Limitee, Quebec, Canada

[21] Appl. No.: 218,833

[22] Filed: Dec. 22, 1980

[51] Int. Cl.[3] ..... B63B 21/56

[52] U.S. Cl. ..... 114/248; 114/249; 114/77 R; 114/352

[58] Field of Search ..... 114/230, 56, 77 R, 242, 114/247–252, 352; 9/2 R, 2 S

[56] References Cited

U.S. PATENT DOCUMENTS

| | | | |
|---|---|---|---|
| 3,357,741 | 1/1971 | Teasdale | 114/248 |
| 3,362,372 | 1/1968 | Peterson | 114/248 |
| 3,486,476 | 12/1969 | Breit | 114/248 |
| 3,613,628 | 10/1971 | Garcia | 114/249 |
| 3,614,938 | 10/1971 | Statle | 114/249 |
| 3,640,238 | 2/1972 | Stockdale | 114/249 |
| 3,735,722 | 5/1973 | Hooper | 114/248 |
| 3,837,315 | 9/1974 | Giblon | 114/248 |
| 4,048,941 | 9/1977 | Legnos . | |

*Primary Examiner*—Charles E. Frankfort
*Assistant Examiner*—D. W. Keen
*Attorney, Agent, or Firm*—Cushman, Darby & Cushman

[57] ABSTRACT

The integrated tug-barge vessel consists of a separable barge and tug; the stern of the barge is formed of a pair of rearwardly extending projections defining a notch therebetween; the inside wall of each stern projection displays a buttress that engages into a longitudinal guideway, defined by a pair of rails on each sidewall of the tug, when the tug approaches the stern notch of the barge; the engagement of this buttress into a constricted portion of the guideway controls the vertical and torsional movements of the tug as it engages the stern of the barge; the disclosure herein is also concerned with describing a coupling device for snugly linking the tug to the barge; it includes a housing located at the stern of the barge and a linkage assembly mounted at the bow of the tug consisting of an hydraulic cylinder that actuates an arm and lever arrangement for the engagement and the disengagement of the tug to and from the barge.

13 Claims, 9 Drawing Figures

10
12
14
16
18
20
22
26
28
30
34
36
38
40
42
44
46
47
50
52
54
56
58

10
12
14
16
34
36
38
40
46
58
60

10
22
42
44
46
47
52
58
59
65
70
80

INTEGRATED TUG-BARGE VESSEL

FIELD OF THE INVENTION

The present invention relates to an integrated tug-barge vessel formed of a separable barge and tug.

BACKGROUND OF THE INVENTION

Various systems have been proposed for replacing the traditional towing of barges on a line, which systems fall into the general category of vessels consisting of a tug positioned behind the barge in a pushing mode. These systems fall into two main classes: non-rigid connection systems allowing a certain degree of freedom between the tug and the barge and rigid systems in which all relative motions between the tug and the barge are restrained allowing both to act as a single vessel unit in a seaway.

In the rigid systems, there are also two main classes: integrated constructions where a tug fits snugly into a deep notch in the stern of the barge and an integrated construction where the tug-barge combination consists of incorporating a twin-screw catamaran tug that fits closely over and around the especially contoured barge stern which is tapered and sloped to form a wedge. In the first instance, it has been observed that, although the integrated system is relatively successful, tugs, in some cases, have stability problems when operated independently and, in other cases, are too specialized for normal service. In the second instance, it has been found that the form of the tug hull is quite unsuitable for even occasional independent operation as a tug boat. It can therefore be concluded from the examination of prior devices that an integrated tug-barge vessel, in order to be economically successful must satisfy at least the following criteria:

(a) it must not be too dimensionally critical so that barges and tugs can be built at different locations and still fit satisfactorily;

(b) as there is a likelihood that there will be more barges than tugs, the interfacing surfaces of the barge must be as simple as possible;

(c) the shape of the tug must be suited for harbor duty;

(d) the tug must have sufficient stability for good independent operation.

In addition to these main points, are the normal criteria of smooth integration to allow a good speed and fuel consumption, ability to engage and disengage with moderate trim differences and the ability to disengage rapidly in an emergency, the latter point being a considerable safety advantage particularly for chemical and tanker barges where fire and explosion are a threat.

STATEMENTS OF THE INVENTION

The present invention is therefore concerned with an integrated tug-barge vessel which comprises: a separable barge and tug, the stern of the barge including a pair of spaced rearwardly extending projections defining a notch therebetween; support means on the inboard sidewall of each stern projection; the sidewalls of the tug including longitudinally extending fender means defining a guideway for receiving therein the support means of the barge to control the vertical and torsional movements of the tug as it engages the stern of the barge; the guideway, toward the stern of the tug, terminating with a constriction for engaging the support means to thereby provide, when the tug is fully integrated to the barge, a rigid support to restrict relative vertical movements between the tug and the barge.

In one particular form of the invention, means are provided on the stern projections of the barge in the form of rubber wheels which project outwardly of the stern projection to contact the deck periphery of the tug during engagement and disengagement of the tug to and from the barge.

In another form of the invention, the deck of the tug and the notch in the barge are substantially trapezoidal in shape so as to mate adequately together when integrated.

Yet, in another form of the invention, an inclined flat platform is provided in the lower part of the stern notch of the barge to receive thereon the correspondingly shaped front hull part of the tug so that the tug may sit partially on the barge stern.

In another form of the invention, wedge means are mounted on the deck at the bow of the tug to engage a correspondingly shaped recess appropriately located in a housing located on the stern deck; this permits the tug's forward part to be held firmly between the bottom platform of the barge and the coupling housing.

In another form of the invention, each stern projection of the barge displays an upwardly and rearwardly inclined undersurface while the tug displays at least one chine having an afterpart lying in the same plane as the said undersurface of an adjacent stern projection.

The present invention is also concerned with providing a coupling device for the final linking of the tug to the barge to form an integrated tug-barge vessel; this device comprises, housing means located at the stern end of the barge; linkage means mounted at the bow end of the tug, the linkage means including: a lever having one end pivotally connected to the tug and an arm having one end pivotally connected to the lever and the opposite end freely movable to be engaged in the housing means of the barge; and double acting actuator means mounted to the tug and operable in a first position to permit engagement of the opposite end of the arm in the housing means and to draw the tug toward the barge to thereby effect integrated coupling therebetween, the actuator means being operable in a second position to push and distance the tug away from the barge thereby permitting disengagement of the tug from the barge.

In one preferred form of the invention, the double acting actuator means consist of an hydraulic cylinder which has one end pivotally connected to the tug and the opposite end pivotally mounted to the opposite end of the lever.

In aother form of the invention, the opposite end of the arm is T-shaped while the housing means have an upwardly inclined ramp and a seat therein with a shape corresponding to that of the T-shaped extremity of the arm; the latter falls into the seat after the extremity has moved up the inclined ramp.

Other objects and advantages of the present invention will become apparent from the detailed description of preferred embodiments of the invention given hereinafter with reference to the accompanying drawings. It is wished to have it understood that modifications and variations can still be made without departing from the scope of the attached claims.

DESCRIPTION OF PREFERRED EMBODIMENTS

Figure 1:
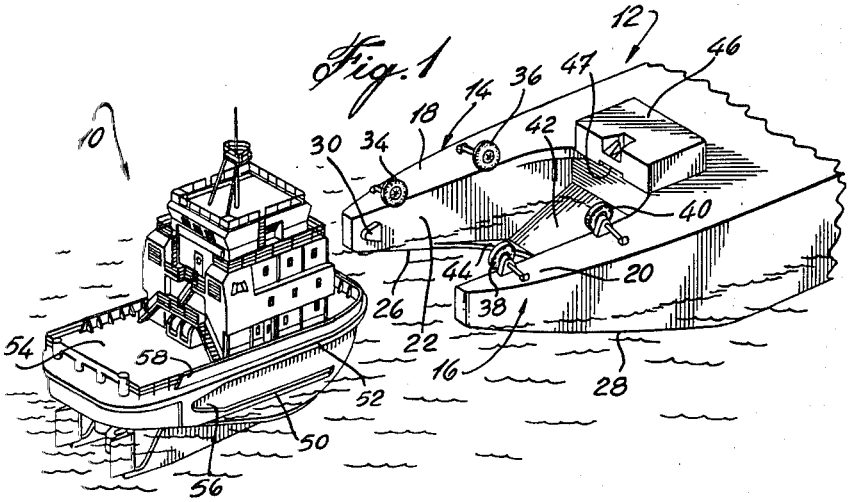
FIG. 1 is a perspective view of an integrated tug-barge vessel made in accordance with the present invention with the barge and tug being shown disengaged.
Figure 2:
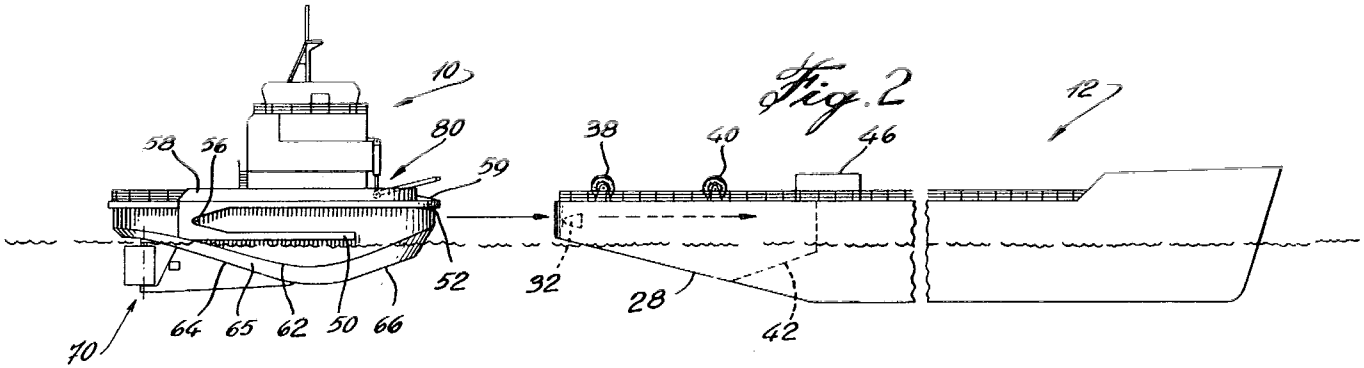
FIGS. 2 and 3 are side elevational views showing the tug and barge vessel in disengaged and engaged positions, respectively.
Figure 3:
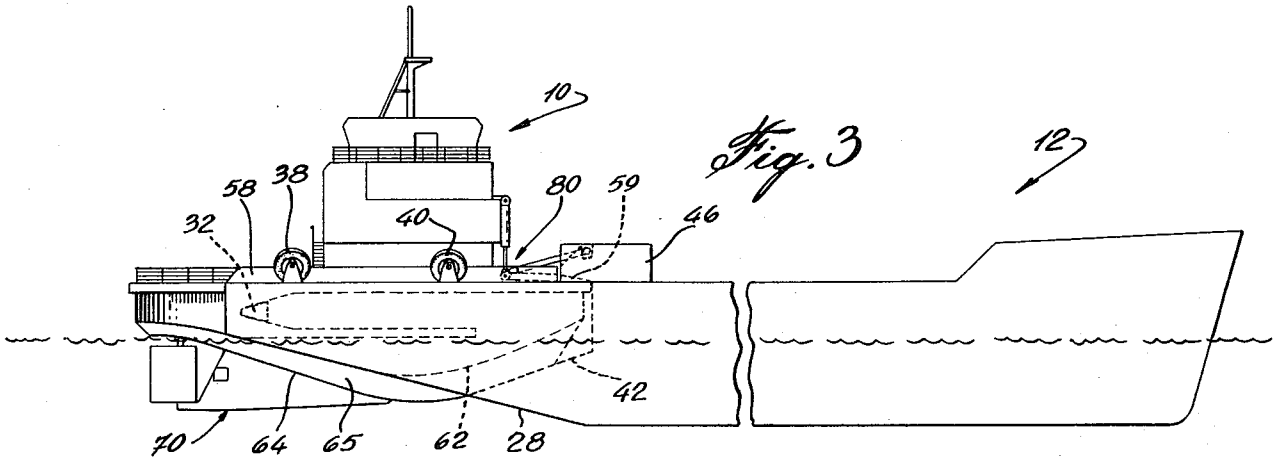

Referring to FIGS. 1, 2 and 3, a tug-barge vessel made in accordance with the present invention basically comprises a tug 10 and a barge 12 which are capable of being connected together to form an integral unit as shown in FIG. 3 as well disengaged or detached to form separate units as shown in FIGS. 1 and 2.

Barge 12 is of conventional construction except for the stern end portion thereof which includes a pair of spaced rearwardly extending projections 14 and 16. These stern projections are identically shaped and each includes a deck 18,20, an inboard sidewall (one of which is seen as 22) and an upwardly inclined undersurface 26,28. A triangular wedge-shaped buttress 30,32 projects at the aft end of each inboard sidewall of the stern projections 14,16.

The two stern projections define a deep trapezoidal shaped notch therebetween as the inboard sidewalls taper outwardly to the rear extremity of the stern projections. Disposed on the top walls 18,20 of the stern projections are wheel assemblies consisting of pairs of inclined pneumatic rubber wheels 34,36 and 38,40 which overhang the notch. Each wheel assembly includes a support which is fixedly attached to the top wall of the stern projection which permits free rotation of the rubber wheels.

At the bottom and inner area of the notch, an upwardly inclined platform 42 is integrally formed with two opposite side fairing pieces 44 secured to the respective inboard sidewall of the stern projections.

The stern deck of the barge also includes a housing 46 partially overhanging the notch. The overhanging undersurface displays a small recessed area 47, the function of which will be described hereinbelow with respect to the coupling mechanism for assembling the tug and the barge together.

Tug 10 is also of generally conventional construction apart from those features described hereinbelow which provide an integral engagement between the tug and the barge and those which allow for improved flow dynamics when the tug and the barge are integrated to one another to form a single vessel unit.

The tug includes on opposite sidewall thereof fender means which, in the present embodiment, take the form of a pair of rails 50,52 the latter being the protruding peripheral edge of deck 54 of the tug. Rail 52 is therefore continuous along both sidewalls as well as at the bow of the tug. The two rails converged near the stern of the tug to define a constriction 56, the shape of which is complementary to that of the triangular shaped buttresses 30,32 on the inner walls of the stern projections.

Figure 4:
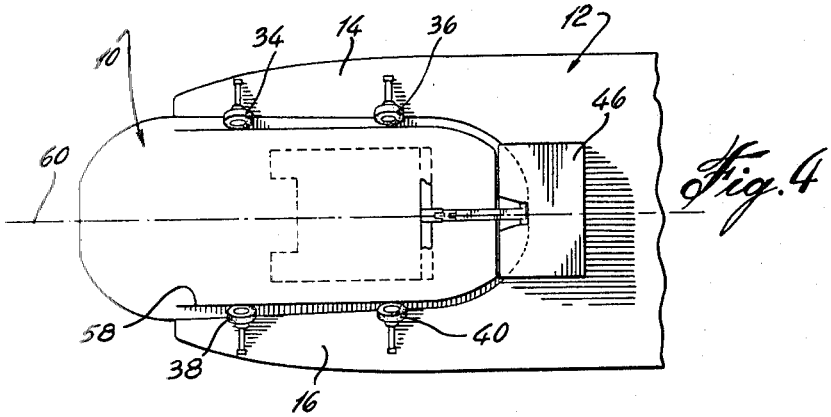
FIG. 4 is a top plan view of the rear portion of the vessel showing the tug and barge in engaged position; this figure is shown on the sheet illustrating FIG. 1.
Figure 5:
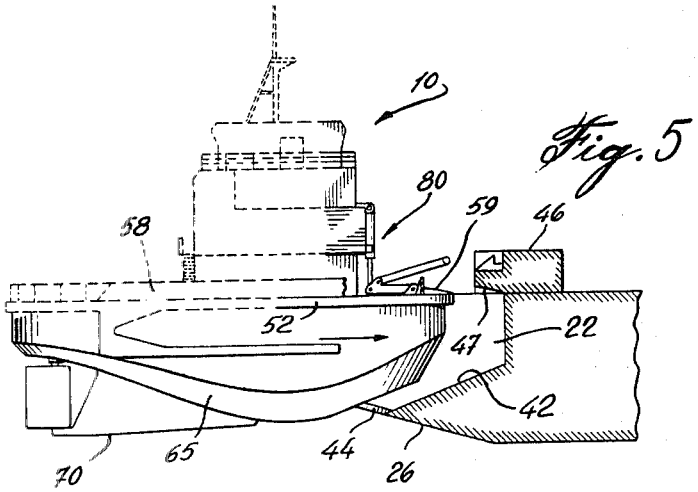
FIG. 5 is a side elevational view showing a tug immediately prior to engagement; this figure is shown on the same sheet as that of FIG. 1.

As can be seen in FIG. 4, the shape of the tug is trapezoidal corresponding to the shape of the notch at the stern position of the barge.

Tug 10 also includes a continuous bulwark 58 that extends on the deck from both sides to the front portion thereof. As can be seen in FIG. 4, the bulwark is inset to the peripheral edge of the deck and extends at an angle to the sides of the tug but parallel to the symmetrical axis 60 of the tug.

Preferably, the tug should be simple in construction and may include a double chine as displayed by upper and lower chines 62,64 in FIG. 2 to define a bilge 65. The tug has a flat front hull portion 66, the slope of which corresponds substantially to that of the inclined platform 42 in the barge notch. As shown in FIG. 3, when the tug and barge are in the integrated position, the afterpart of the upper chine 62 is in the same inclined plane as the associated underface 28 of the stern projection to provide a clean hydrodynamic flow in the area were the tug and barge meet when coupled together. The hard chine form can be made with plate surfaces which are either conical or cylindrical or both, so that no plates have double curvature, which is simple to form.

Referring generally to FIGS. 1 to 5, the engagement of the tug to the barge is effected by advancing the tug into the notch portion of the barge. The buttresses 30,32 are received between rails 50,52 to thereby control vertical and torsional movements of the tug. The system of inclined pneumatic wheels is provided to allow the tug to glide while trimmed into its position; this also prevents the tug from being lifted by small waves above the deck of the barge. Also, these rubber wheels act as shock absorbers as the two units fit together. The slightly offset bulwark of the tug is used as a longitudinal guide to the wheels to guide the tug as it engages with the barge. As the tug further enters the notch of the barge, the wedge-shaped buttresses 30,32 slide into the constriction portion 56 of the fender means to provide a rigid support that eliminates relative vertical movement between the two units. The bow of the tug being designed with an angle corresponding to the slope of the front part of the barge notch, this permits the tug's forward end to be firmly held between the bottom of the barge and the deck coupling housing 46. Platform 42 should preferably be wood-sheathed to reduce friction between the two parts as they engage or are engaged as a single unit.

A double skeg arrangement 70 is preferably provided at the rear portion of the tug.

Another important feature of the present invention is a device for the final coupling of the tug and the barge once the tug has come to rest on platform 42 of the barge. This coupling device is shown at 80 in FIGS. 1 to 5; however, it will be described in greater detail with reference to FIGS. 6–9, inclusively. It includes a cavity 82 which opens at the rear and top portion of housing 46 to display an inclined ramp 84 and a T-shaped seat which consists of a rear pocket 86 and of an inclined slot 87 at the center of the inclined ramp 84. As described above, a recess 47 is provided in the undersurface of housing 46 to receive a wedge-shaped block 88 at the front part of the tug deck between the bulwark 58 and the peripheral edge 52.

Figure 6:
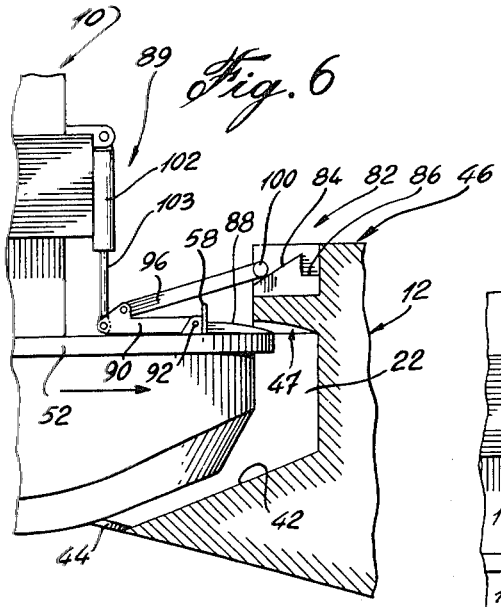
FIGS. 6 to 9 show the successive engagement operations carried out by the coupling device of the present invention.
Figure 7:
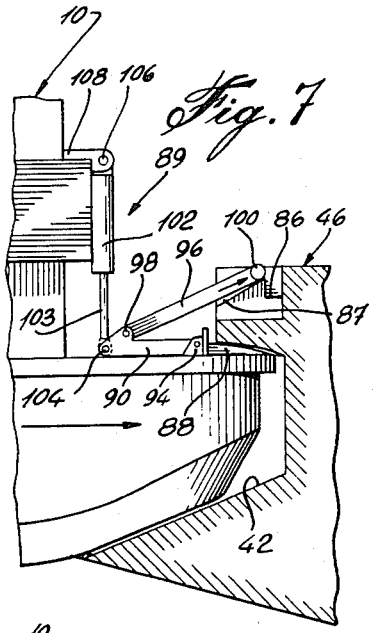
Figure 8:
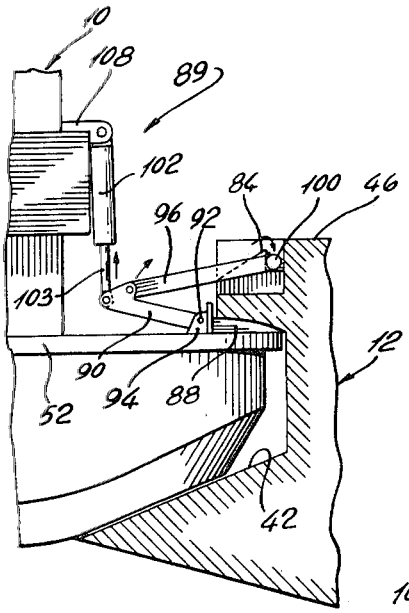
Figure 9:
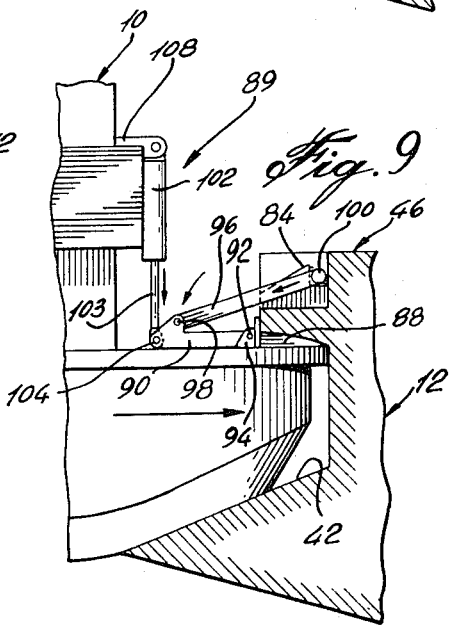

The coupling device also consists of a link assembly 89 which is mounted on the front of the tug. This linkage assembly consists of a lever 90 having one end 92 pivotally connected to a support 94 secured to the deck of the tug. The linkage assembly also includes an arm 96 pivotally mounted at 98 to the lever 90. The opposite end of arm 96 includes a cylindrical portion 100 having a width slightly smaller than that of the cavity 82 so that it can be received in the rear pocket 86 such as shown in FIGS. 6, 7 and 8. Also, mounted to the lever 90 adjacent the pivot point 98 is an hydraulic cylinder 102 with piston rod 103 pivotally connected at 104 to lever 90 while the opposite end 106 is pivotally connected to a bracket 108 fixedly attached to the tug construction. Although, not shown in the drawings, the operation of the hydraulic cylinder is carried out by drive means associated with the tug.

In operation, a final tight coupling arrangement between the tug and barge is accomplished by advancing the tug (see FIG. 6) so that the arm 96 presents its cylindrical portion 100 to the ramp 84. As the tug further engages the barge, (see FIG. 7) the cylindrical portion 100 on the arm 96 approaches pocket 86 of cavity 82 while the tapered block 88 is received in the correspondingly shaped recess 47 under the housing. Then, the hydraulic cylinder 102 is actuated retracting piston rod 103 and causing lever 90 to pivot outwardly. Simultaneously arm 96 moves toward the barge causing the cylindrical portion 100 to drop into the pocket 86 and the adjacent portion of arm 96 to sit in the center slot 87 of the inclined ramp 84. (See FIG. 8) Referring to FIG. 9, cylinder 102 is once again actuated to return lever 90 to its original horizontal position on the deck causing arm 96 to pull the barge into final engagement so that the front end of the tug is tightly fitted between the platform 42 and the housing 46.

To disengage the tug from the barge, the reverse steps of the above operations are performed, mechanical means (not shown) being provided to lift arm 96 out of pocket 86 when the cylinder is in the position shown in FIG. 8.

In the engaged position, the tug and barge form a unitary vessel so that the shape of the hull portions of the barge and the tug complement one another to provide a clean flow of water to the propellers of the tug. The provision of the two side projections 44 prevents any turbulence which would otherwise be created by an open area at these locations.

It can therefore be seen that the provision of such coupling device to allow barges and tugs to be built with dimensions which are not required to be critical.

The embodiments of the invention in which an exclusive property or privilege is claimed are defined as follows:

1. An integrated tug-barge vessel having a separable barge and tug, said barge including (1) a pair of spaced rearwardly extending stern projections defining a notch in the stern of said barge, each projection having an inboard sidewall and an adjacent upper surface (2) a buttress projecting from the inboard sidewall of each said projection, and (3) means on each said upper surface for engaging the deck of said tug to limit upper movement thereof, and said tug including sidewalls extending from stem to stern and a pair of spaced rails extending longitudinally of each said sidewall to define a guideway for receiving said buttress, said guideway converging to a constriction having a shape complementary to said buttress to provide, when said buttress is received therein, a rigid support restricting relative vertical and torsional movements between tug and barge when integrated.

2. A vessel as defined in claim 1, wherein said means on said stern projections consist of rubber wheel means supported for rotation on said stern projections, said wheel means overhanging inboard from said stern projections and able to contact the deck of said tug during engagement and disengagement between said tug and said barge.

3. A vessel as defined in claim 2, further comprising a bulwark on the deck of said tug, said bulwark having portions extending longitudinally and inset relative to the peripheral edge of said deck thereby defining an area allowing said rubber wheels to roll thereon; said rubber wheels guiding said bulwark as said tug engages with and disengages from said barge.

4. A vessel as defined in claim 3, wherein said bulwark extends parallel to the longitudinal symmetrical axis of said tug; said rubber wheel means consisting of two or more wheels longitudinally spaced along said stern projections.

5. A vessel as defined in claim 1, wherein the deck of said tug and said notch of said barge are substantially trapezoidal in shape to mate adequately when integrated to one another.

6. A vessel as defined in claim 1, wherein the barge includes in said notch a lower inclined platform extending between said projections; said tug having a bow with an inclination corresponding substantially to that of said inclined platform.

7. A vessel as defined in claim 6, wherein said platform is wood-sheathed.

8. A vessel as defined in claim 6, further comprising wedge means on the deck of said tug at the bow thereof; housing means on said barge to engagedly receive said wedge means therein whereby the bow of said tug is snugly fitted between said housing means and said platform.

9. A vessel as defined in claim 1, wherein the hull of said tug includes one or more chine on each side thereof formed of plate surfaces having conical and cylindrical curvature.

10. A vessel as defined in claim 1, wherein each stern projection of the barge includes an upwardly and rearwardly inclined undersurface; said tug having at least one chine having an afterpart lying in the same plane as the inclined undersurface of an adjacent stern projection.

11. A device for coupling a tug to a barge to form an integrated tug-barge vessel, said tug having a bow end, said barge having a stern end therein to receive at least said bow end of said tug, comprising, in combination:

(a) housing means located at said stern end of said barge, and having an inclined ramp and seat;

(b) linkage means mounted at said bow end of said tug; said linkage means including a lever having one end pivotally connected to said tug and an arm having one end pivotally connected to said lever and the opposite end freely movable to be engaged in said housing means on said barge; and (c) double acting actuator means including a hydraulic cylinder having one end pivotably mounted to said tug and the opposite end pivotably connected to said lever and operable in a first position to permit engagement of said opposite end of said arm in said housing means of said barge as said opposite end of said arm falls into said seat after moving up said ramp and to draw said tug toward said barge to thereby effect integrated coupling therebetween, said actuator means being operable in a second position to push and distance said tug away from said barge thereby permitting disengagement of said tug from said barge.

12. A device as defined in claim 11, wherein said opposite end of said arm has a T-shaped extremity; and said housing means has a shape corresponding to that of said T-shaped extremity; said T-shaped extremity falling into and being received in said seat after said extremity has moved up said inclined ramp.

13. A device as defined in claim 11, further comprising wedge means on the deck of said tug at the bow thereof; said housing means having an underside shaped to fit therein said wedge means.

* * * * *